US006260368B1

(12) United States Patent
Redlich

(10) Patent No.: US 6,260,368 B1
(45) Date of Patent: Jul. 17, 2001

(54) EVAPORATOR SUPERHEAT STABILIZER

(76) Inventor: Robert Walter Redlich, 9 Grand Park Blvd., Athens, OH (US) 45701

( * ) Notice: Subject to any disclaimer, the term of this patent is extended or adjusted under 35 U.S.C. 154(b) by 0 days.

(21) Appl. No.: 09/480,233

(22) Filed: Jan. 10, 2000

(51) Int. Cl.[7] ..... F25B 41/00; F25B 43/00
(52) U.S. Cl. ..... 62/212; 62/503
(58) Field of Search ..... 62/503, 225, 212

(56) References Cited

U.S. PATENT DOCUMENTS 4,523,435 * 6/1985 Lord ..... 62/212
4,527,399 * 7/1985 Lord ..... 62/212
4,878,355 11/1989 Beckey et al. .
5,505,060 * 4/1996 Kozinski ..... 62/503

OTHER PUBLICATIONS

Finn, D.P. & Doyle, C.J. . A BEMS–Integrated Electronic Expansion Valve for Real Time Optimization of Refrigeration. 20th International Congress of Refrigeration, IIR/IIF. Sydney, Australia, 1999.

* cited by examiner

*Primary Examiner*—William Wayner
(74) *Attorney, Agent, or Firm*—Frank H. Foster; Kremblas, Foster, Phillips & Pollick

(57) ABSTRACT

In a vapor compression refrigerator with closed loop feedback control of evaporator superheat, a superheat stabilizer consisting of a cavity connected between the evaporator outlet and the suction line inlet, the cavity combining the functions of liquid separation and vapor superheating in order to stabilize superheat by preventing liquid from reaching the outlet vapor temperature sensor and also by achieving preset superheat downstream of the evaporator.

3 Claims, 2 Drawing Sheets

SECTION A-A

EVAPORATOR SUPERHEAT STABILIZER

REFERENCES

1. Finn, D. P., and Doyle, C. J.; "A BEMS-Integrated Electronic Expansion Valve For Real-Time Optimization of Refrigeration Evaporation". 20th International Congress of Refrigeration, IIR/IIFT, Sydney Australia, 1999.

2. U.S. Pat. No. 4,878,355

TECHNICAL FIELD

This invention relates to vapor compression refrigeration having evaporator superheat regulation by a closed loop control whose input is superheat temperature and whose output is a control signal which causes an electronic expansion valve to increase refrigerant flow in response to increased superheat. Specifically the invention is concerned with stabilizing the superheat control loop.

BACKGROUND ART

Vapor compression refrigerators achieve maximum efficiency when the evaporator, in which liquid refrigerant is vaporized by heat absorbed from the refrigerated space, is supplied at its inlet with an optimum mass flow of liquid refrigerant that is just sufficient so that vaporization is complete at the evaporator outlet. Flow in excess of the optimum results in liquid refrigerant leaving the evaporator outlet, thereby sacrificing its refrigeration capability.

Flow less than optimum results in complete vaporization occurring within the evaporator. Between the point of complete vaporization and the evaporator outlet, vapor is "superheat", as used in reference to vapor compression refrigeration, means the difference between the temperature of vapor at some point in the suction live downstream of the evaporator and the temperature of the liquid-vapor mixture at the evaporator inlet. High superheat is a source of inefficiency because only part of the evaporator is available to absorb heat by efficient heat transfer from the refrigerated medium to boiling liquid refrigerant. The remaining part transfers heat inefficiently from the refrigerated medium to refrigerant vapor. The result is that superheat causes the evaporator to operate at lower than optimum temperature and pressure, requiring more compressor work per unit of refrigeration.

Nearly optimum flow of refrigerant has been achieved in prior art with electronically controlled expansion valves (EEVs). Some prior art EEVs regulate refrigerant flow with an electromechanically adjustable flow resistor such as a needle valve. In others, an electromechanical valve periodically opens to admit flow to a fixed orifice for a controllable time interval.

In prior art, an EEV is part of a closed loop feedback control in which superheat is sensed by temperature sensors, and a superheat signal controls an EEV so as to increase refrigerant flow when superheat temperature increases above a preset value and reduce refrigerant flow when superheat falls below the preset value. Since increased flow reduces superheat, the system has negative feedback and will, if it is stable, settle at or near the preset superheat. The value of preset superheat is typically below 7 degrees Centigrade, which is low enough so that most of the evaporator is used efficiently.

In an EEV control loop, a step increase in flow rate at the evaporator input generates a corresponding step increase in flow rate at the evaporator output after a delay equal to the time required for refrigerant to transit the evaporator. This delay is typically about 10 seconds, and has serious implications for control loop stability, as may be seen from the following sequence of events in a "proportional only" EEV control in which change in flow rate is simply proportional to change in superheat.

Suppose that a "proportional only" system has been running with preset superheat, and at time=0, a disturbance such as a momentary interruption of power, causes superheat to increase well above its preset value. Then, at time=0, the EEV will automatically be stepped to high flow rate in an attempt to restore preset superheat. Assuming a delay time of 10 seconds, the step increase in flow results in liquid refrigerant reaching the output temperature sensor at time=10 seconds. In a short time interval prior to and after the arrival of liquid at the output temperature sensor, the sensor temperature and consequently the superheat signal both decrease, and the controller reacts with an abrupt decrease in flow rate at the evaporator input. However, this decrease does not reach the output temperature sensor until time=20 seconds, at which time the superheat signal abruptly increases and the foregoing sequence begins to repeat itself.

In prior art, EEV controls have been stabilized electronically by empirical adjustment of a "PID" (proportional-integral-differential) controller (Ref. 1, FIG. 2)., which typically results in slow controller response and low margins of stability. Also, the cost of a PID controller precludes its use in many applications.

Accordingly, the purpose of the present invention is to provide inexpensive stabilization an EEV control loop so as to achieve a high margin of stability and relatively fast controller response with "proportional only" control.

BRIEF DISCLOSURE OF THE INVENTION

In a refrigerator system using the invention, all superheat takes place downstream of the evaporator, and liquid is prevented from reaching the location of the sensor that measures temperature of the superheated vapor, thereby eliminating abrupt, delayed changes in temperature of that sensor which, as previously described herein, cause severe instability. Eliminating the source of instability enables the use of simple, inexpensive "proportional only" EEV control whereby an EEV control signal is simply proportional to a superheat temperature signal.

The basic invention is a metal cavity installed downstream of the evaporator and inside the refrigerated space. The cavity performs two functions; separation of liquid from vapor and superheating of the separated vapor. Separated vapor is superheated within the cavity by heat transferred from the refrigerated space through the cavity walls, the amount of superheat being substantially a preset value. The sensor that measures superheated vapor temperature is located downstream of the cavity.

A combined form of the invention is a cavity as described above combined with "proportional only" EEV control. This combination results in a stable system, while "proportional only" control without a cavity according to the invention is unstable.

DETAILED DESCRIPTION OF THE INVENTION

Figure 1:
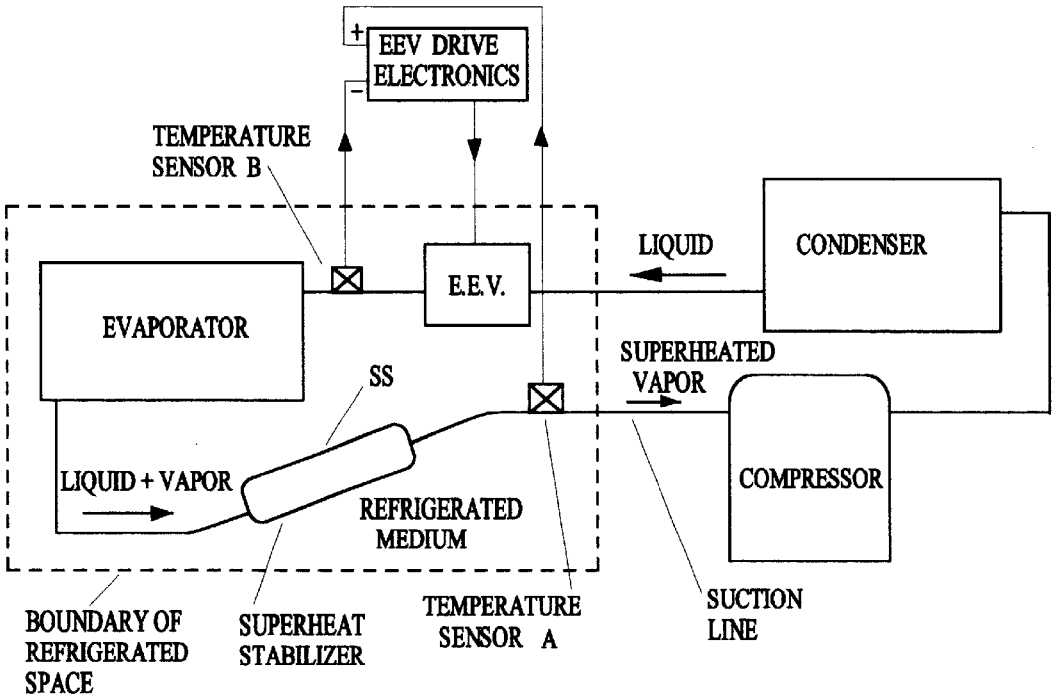
FIG. 1 is a block diagram of a vapor compression refrigerator using an EEV and the invention.

Referring to FIG. 1, which conforms to prior art except for addition of a superheat stabilizer according to the invention; superheated vapor in the suction line enters the compressor and is discharged from the compressor as vapor at high pressure and temperature. Discharged vapor enters the condenser, where it is cooled and liquefied. Liquid enters the EEV, which controls flow rate and reduces pressure so that a cold mixture of liquid and vapor exits the EEV and enters the evaporator at a controlled rate. In its passage through the evaporator, the liquid component of the refrigerant is vaporized by heat absorbed from the refrigerated medium surrounding the evaporator. Highest efficiency is achieved if vaporization of liquid is complete a or near the location where the suction line exits the refrigerated space, but not upstream of that location. Departures from maximum efficiency are detected by measuring the difference in refrigerant temperatures at or near the point where the suction line exits the refrigerated space and at the evaporator inlet, by means of temperature sensors A and B respectively. The condition where vaporization is incomplete and liquid refrigerant leaves the refrigerated space in the suction line manifests itself as a temperature at the location of temperature sensor A that is equal to (or slightly lower, due to pressure drop in the evaporator) than the temperature at the location of temperature sensor B. The condition where vaporization is complete upstream of temperature sensor A manifests itself as "superheat", that is, a temperature at sensor A's location higher than that at the location of sensor B.

Figure 2:
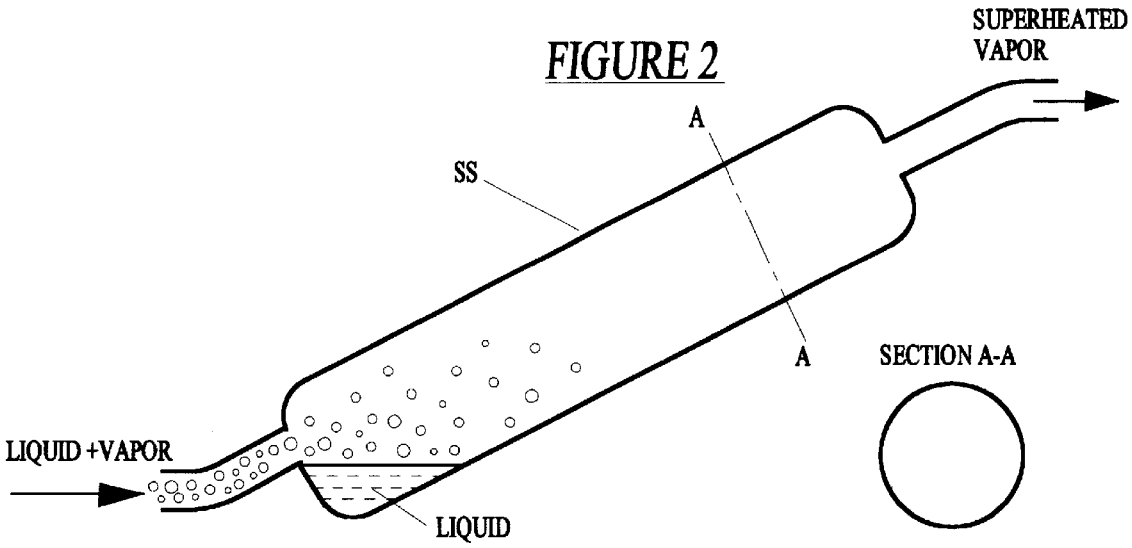
FIG. 2 illustrates two cross sections of a preferred embodiment of the invention, one of which shows the locations of mixed liquid and vapor, separated liquid, and separated vapor during operation of a vapor compression refrigerator using the invention.

To maintain refrigerant flow at or near the most efficient rate, the EEV is connected in a negative feedback loop whereby a superheat signal equal to the difference between the output of sensor A and the output of sensor B is applied to an electronic EEV driver that controls the EEV in such a way that, when superheat exceeds a preset value, the EEV increases refrigerant flow, and when superheat is below the preset value, the EEV reduces refrigerant flow. As previously explained herein. Such a control loop in a system not using the invention will be severely unstable if the control is "proportional only", i.e., if change in refrigerant flow is proportional to superheat, the cause of instability being abrupt, delayed decreases or increases in temperature of sensor A that occur when liquid reaches the evaporator outlet or retreats from it respectively, in response to, respectively, step increases or decreases in refrigerant flow. The invention stabilizes the system by preventing liquid from reaching temperature sensor A by means of a liquid-vapor separator, a preferred form of which is shown in FIG. 2, thus eliminating the basic cause of severe system instability. The liquid-vapor separator is a cavity in the refrigerated space and between the evaporator outlet and temperature sensor A with the cavity outlet higher than the cavity inlet. By making the cavity cross section sufficiently large, flow velocity inside the cavity is caused to be low enough to allow liquid drops entrained with vapor to separate and collect at the upstream (low) end of the cavity,. The cavity is made long enough in the direction of flow to ensure that little or no entrained liquid reaches the cavity outlet, and so that vapor exiting the cavity is superheated to a temperature such that preset superheat is achieved at the location of temperature sensor A. In FIG. 2, liquid drops within the cavity are shown as small circles, which become sparser as the cavity exit is approached, in order to illustrate progressive separation of liquid and vapor.

For lowest cost, the preferred form for the cavity is a circular cylinder as illustrated in FIG. 2.

Figure 3:
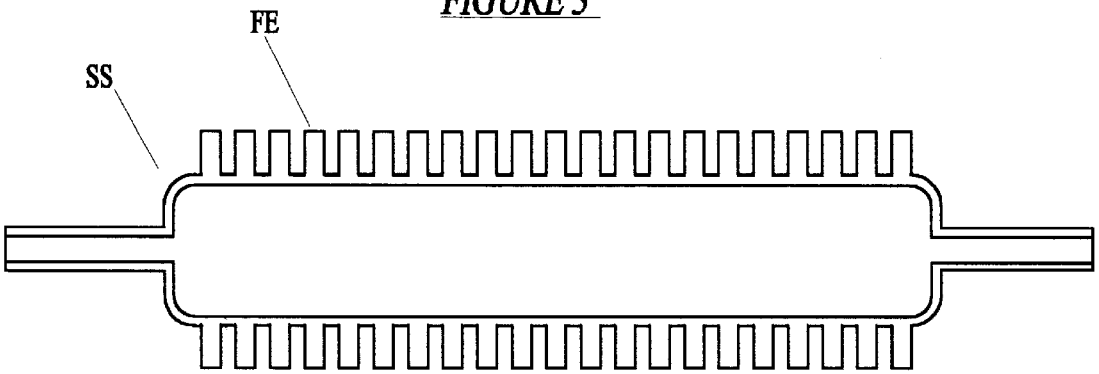
FIG. 3 is a form of the invention using external fins to enhance heat transfer from the refrigerated space to the wall of a combined superheater and liquid separator.
Figure 4:
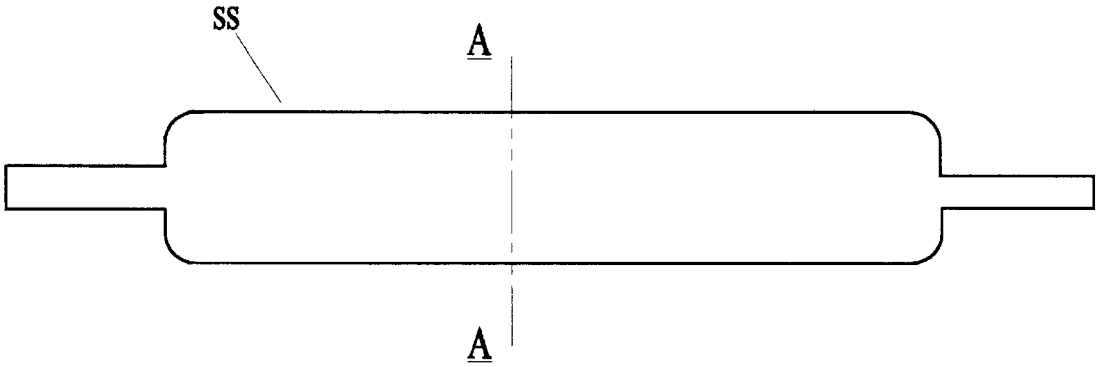
FIG. 4 is a form of the invention using internal fins to enhance heat transfer from the refrigerant to the wall of a combined superheater and liquid separator.
Figure 4:
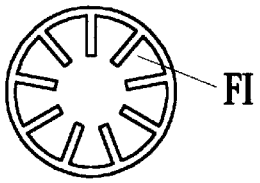

In installations having limited space available for the invention, it may be advantageous to reduce the length of the cavity while still achieving preset superheat, by adding an external or internal heat exchanger to the cavity to compensate for reduction in heat transfer area resulting from length reduction. FIG. 3 shows the invention with an external heat exchanger in the form of external fins FE. FIG. 4 shows an internal heat exchanger in the form of internal fins FI.

Some prior art vapor compression refrigeration systems use a liquid accumulator located in the suction line between the evaporator outlet and the compressor, that is, in the same location as the cavity of the present invention. For example, FIG. 1 of Reference 2 shows such an accumulator. However, a liquid accumulator is designed for a different purpose than the combined liquid separator and vapor superheater of the invention, namely, for collection of liquid refrigerant that overflows th evaporator when the compressor is shut off. A liquid accumulator will thus not generally fulfill the functions required of the invention, and the associated system will require PID control for stability (ref. 2, pg. 3, lines 21–27).

What is claimed is:

1. An evaporator superheat stabilizer for use in a vapor compression refrigeration system, the system having feedback control of evaporator superheat, the system including the following elements a)–d), a) an evaporator for the purpose of cooling a refrigerated space, the evaporator having an inlet and an outlet, b) a suction line whose inlet receives vaporized refrigerant from the evaporator outlet, c) an electronically controlled expansion valve having an inlet which receives high pressure liquid from a condenser and an outlet which discharges a controlled flow of low pressure refrigerant through a passage into the evaporator inlet, and d) a feedback controller having an input signal equal to the difference between a signal from a first temperature sensor located at a point on the surface of or within the suction line and a signal from a second temperature sensor located at a point on the surface of or within said passage, the controller generating a proportional control output signal that controls the expansion valve so as to cause increased refrigerant flow when superheat increases above a preset superheat value, superheat being defined herein as the difference between a first temperature at the location of the first temperature sensor and a second temperature at the location of the second temperature sensor, said superheat stabilizer comprising, a cavity, located in the refrigerated space and functioning as both a liquid separator and a vapor superheater, the cavity having a cavity inlet connected through a passage to the evaporator outlet and a cavity outlet connected to the suction line inlet, the cavity having sufficiently large cross sectional area so that refrigerant velocity within the cavity is low enough to allow separation of liquid and vapor, the cavity being sufficiently long in the direction of refrigerant flow so that only refrigerant vapor exits the cavity, the cavity also being sufficiently long in the direction of refrigerant flow so that said preset superheat occurs between the evaporator outlet and the location of said first temperature sensor.

2. A superheat stabilizer according to claim 1, having in addition an internal heat exchanger inside said cavity to enhance heat transfer between the interior of said cavity and said refrigerated space.

3. A superheat stabilizer according to claim 1, having in addition an external heat exchanger outside said cavity to enhance heat transfer between the interior of said cavity and said refrigerated space.

* * * * *